United States Patent [19]

Dukess

[11] Patent Number: 4,457,440

[45] Date of Patent: Jul. 3, 1984

[54] CAP LINER HAVING AN INTERMEDIATE LAYER OF DISCRETE STRIPS

[76] Inventor: Joseph Dukess, 708 Greenwich St., New York, N.Y. 10014

[21] Appl. No.: 395,539

[22] Filed: Jul. 6, 1982

[51] Int. Cl.[3] ..... B65D 41/12

[52] U.S. Cl. ..... 215/347; 215/349; 215/350

[58] Field of Search ..... 215/260, 261, 347, 348, 215/349, 351; 220/295; 428/64

[56] References Cited

U.S. PATENT DOCUMENTS

| | | | |
|---|---|---|---|
| 1,320,863 | 11/1919 | Jackson | 215/351 |
| 3,045,854 | 7/1962 | Patton | 215/260 |
| 3,595,419 | 7/1971 | Dukess | 215/347 |
| 3,819,460 | 6/1974 | Dukess | 215/347 |
| 3,917,100 | 11/1975 | Dukess | 215/347 |
| 3,963,845 | 6/1976 | Dukess | 215/347 |
| 3,976,217 | 8/1978 | Dukess | 215/347 |
| 4,121,728 | 10/1978 | Tagalakis et al. | 215/260 |

FOREIGN PATENT DOCUMENTS

| | | | |
|---|---|---|---|
| 486516 | 3/1949 | Canada | 215/347 |
| 87416 | 6/1959 | Fed. Rep. of Germany | 215/349 |

*Primary Examiner*—Joseph Man-Fu Moy
*Assistant Examiner*—David Fidei
*Attorney, Agent, or Firm*—Alan H. Levine

[57] ABSTRACT

A cap liner in the form of a sandwich and so arranged that a compressible intermediate layer in the form of discrete compressible strips of relatively great thickness is disposed between two relatively thin non-resilient outer layers. The intermediate layer can be squeezed beyond the periphery of the material for making a better seal and the separate rods will be joined together in abutting fused relationship when the intermediate layer is so compressed. One of the outer layers can be eliminated, in which case the top wall of the cap serves in its place.

6 Claims, 5 Drawing Figures

FIG. 1
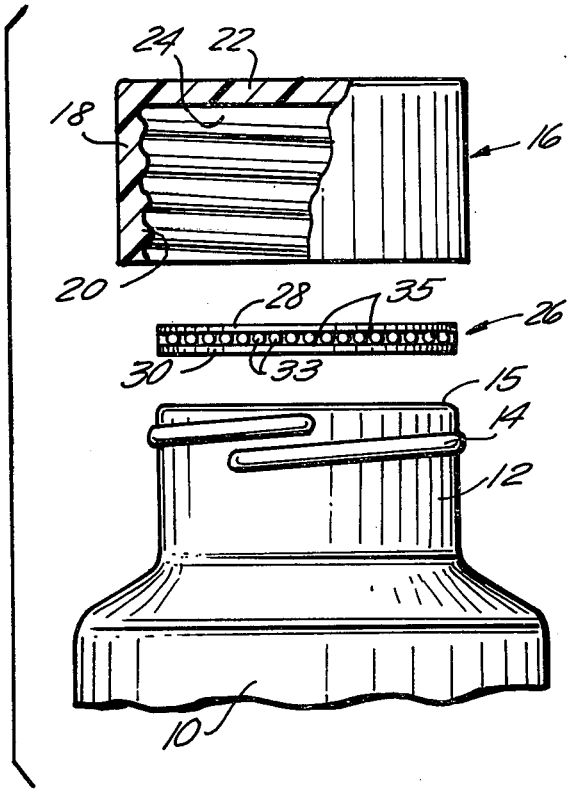
FIG. 3
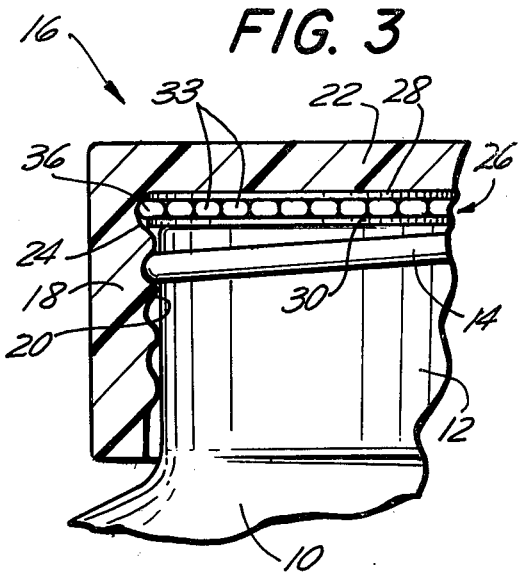
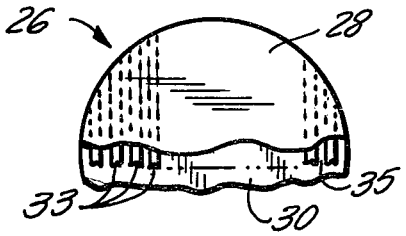
FIG. 2
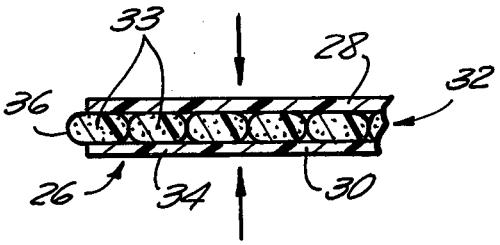
FIG. 4
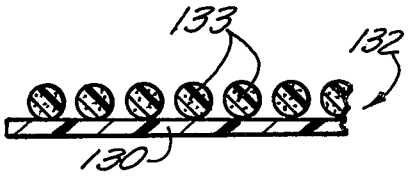
FIG. 5

CAP LINER HAVING AN INTERMEDIATE LAYER OF DISCRETE STRIPS

This invention relates to material for cap liners and is an improvement over my previous U.S. Pat. Nos. 3,595,419 and 3,819,460.

Various types of cap liners have been devised in the past. These liners are employed to seal the contents of the container, preventing leaking between the threaded portions of a container neck and the cap by providing for a positive seal at the mouth of the container. Such previous cap constructions, and liners and material used for liners, as disclosed in my previous patents include a thick compressible layer between two hard thin layers. This has required the use of considerable material for the compressible layer. The present invention reduces the amount of compressible material needed, as compared to the liners of the prior art, while having other advantages.

A further advantage of the present invention is that liners according to the invention are capable of being stamped out of stock liner material, without freezing, even more easily than those of my prior patents.

A further advantage according to the present invention is that relatively thinner compressible material can be used when sealing certain volatile liquids, allowing a further saving of material.

One of the features of the invention resides in liner material capable of forming a liner that is freely rotatable within the cap until such time as the mouth of the container is firmly against the liner. Thereafter, the liner is compressed so that an intermediate layer of the liner formed of spaced strips or rods, is compressed and expanded outwardly to abut against the side walls of the cap for making a most effective seal while also fusing the rods to each other.

A further object of the invention resides in the production of a liner material that is capable of being extruded as a multi-layer sandwich.

Still further objects and features of this invention reside in the provision of a liner that is capable of being extruded by conventional machinery, and which can be conveniently stamped to shape without requiring freezing, thereby permitting manufacture at a relatively low cost, and which is highly effective in use.

The present invention provides a cap liner having an intermediate layer between discs of a relatively thin hard material. The intermediate layer includes a plurality of relatively thick strips as compared with the thickness of the two outer discs. When the liner is compressed, the strips of the intermediate layer will not only be fused together but will be expanded outwardly beyond the discs to form a seal against the cap. The strips are preferably in the shape of cylindrical rod-like extrusions.

These, together with various ancillary objects and features of this invention, which will become apparent as the following description proceeds, are attained by this cap liner, a preferred embodiment of which is illustrated in the accompanying drawing, by way of example only, wherein:

FIG. 1 is an exploded view partly in cross-section, illustrating the liner, and an associated cap, made from liner material according to the invention;

FIG. 2 is a face view of the liner, with parts broken away;

FIG. 3 is a cross-sectional view on a larger scale, showing the liner and cap secured on the neck of a container;

FIG. 4 is a cross-sectional view on a still larger scale, of the liner; and

FIG. 5 is a cross-sectional view of a modified form of liner.

With continuing reference to the accompanying drawing, wherein like reference numerals designate similar parts throughout the various views, reference numeral 10 is used to generally designate a conventional container such as a bottle, tube, or can having a neck 12 which is threaded at 14. In order to provide a closure for the container 10, a cap 16 is employed which includes cylindrical side walls 18, which are internally threaded at 20, and a top wall 22. A cylindrical groove 24 is formed as the uppermost of the threads 20 and is for the purpose of receiving therein a liner 26. The cap 16 is preferably molded out of any suitable synthetic plastic material and is adapted to be threadedly secured on the neck 12 with the threads 20 engaging the threads 14.

The liner 26, see FIG. 4, is from a liner material, in accordance with the invention, formed of a sandwich of outer layers 28 and 30, and an inner layer 32, the liner 26 preferably being stamped in the shape of a disc. The outer layers 28 and 30 are formed of a low density polyethylene, such as that sold under the trademark "Alathion 20." This material is stress resistant, crack resistant, relatively non-resilient, impervious and is extruded in a very thin layer in the order of approximately $1\frac{1}{2}$ thousandths of an inch. The intermediate layer 32 is a thermoplastic rubberlike material such as butylene in polyethylene known as pliothene, or other resilient material such as ethylene vinyl acetate or the material sold under the trademark Karton, which is a thermoplastic rubber. Particularly, this material is resilient though not necessarily as resistant to stress and cracks, or as impervious to foreign substances, as the material of the outer layers 28 and 30. The material 32 is in the form of discrete strips such as cylindrical rods 33. When the sandwich is manufactured by way of simultaneous multiple extrusion, the outer layers 28 and 30 are extruded at a temperature of approximately 300° to 400° F. while the intermediate rods 33 are extruded at approximately 200° to 300° F. The various layers are brought together within a combination die, and at about 300° F., for bonding within the combination die. The resultant sheet material has a much increased resistance to distortion or stress, can be stamped without freezing, and is impervious to chemicals and acids as well as moisture.

When the disc 26 is inserted into the groove 24 in a normal state, it will freely rotate therein permitting for effective engagement of the mouth edge 15 of the container 10 against the under surface 34 of the layer 30. Continued closure of the cap 16 will cause the resilient intermediate rods 33 to be compressed extruding a tongue 36 beyond the peripheral edges of the outer layers 28 and 30, as shown in FIGS. 3 and 4. Tongue 36 is thereby pressed against the inner wall of the groove 24, frictionally sealing the liner 26 with the cap 16. Closure of the cap also causes fusing of the rods to each other to form a unitary intermediate layer 32.

When used with products containing alcohol or petroleum distillates, if the container is overturned before the liner is compressed, fluid will pass into the interstices 35 (FIG. 1) between the rods 33 causing the rods to swell and thereby permitting use of rods 33 of lesser thickness. Thus, there is achieved an inner effective seal and closure for the contents of the container 10, with less material used than heretofore possible, while retaining all of the desirable features of the non-resilient low density polyethylene which is used for the outer layers. In addition, the layers are relatively thin, so as to permit for an effectively resilient liner while reducing the thickness of the liner over my prior patents.

It has been found that for the liner material according to the invention it is desirable that the intermediate layer 32 be 5 to 10 times the normal width of each of the outer layers 28 and 30.

In FIG. 5 there is shown a modified form of the invention wherein a two-ply liner is used. In this embodiment, the top wall 22 of the cap 16 serves as the upper outer liner, there being only an intermediate layer 132 formed of rods 133, and a lower outer liner 130.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A cap liner comprising a disc having at least one outer layer and an intermediate layer bonded to said outer layer, said outer layer being relatively thin and non-resilient, said intermediate layer including a plurality of discrete spaced strips and being resilient, compressible, and relatively thick, said strips, when the liner is uncompressed, being completely separate from each other and unconnected to each other except by said outer layer.

2. A cap liner as in claim 1, wherein said strips, when compressed, extend outwardly of said outer layer and are fused together.

3. A cap liner according to claim 1, wherein there are two outer layers, said strips being sandwiched between and bonded to said outer layers.

4. A cap liner according to claim 3, wherein said strips are in the form of discrete cylindrical rods.

5. A cap liner according to claim 4, wherein said rods are from 5 to 10 times the thickness of each of said outer layers.

6. A cap liner according to claim 5, wherein said rods are sufficiently closely spaced to fuse when said cap liner is compressed.

* * * * *